US008662888B2

(12) United States Patent
Moller et al.

(10) Patent No.: US 8,662,888 B2
(45) Date of Patent: Mar. 4, 2014

(54) LOADING SYSTEM FOR A HEAT TREATING FURNACE

(75) Inventors: Craig Moller, Roscoe, IL (US); Christopher S. Hawkins, Rockford, IL (US)

(73) Assignee: Ipsen, Inc., Cherry Valley, IL (US)

( * ) Notice: Subject to any disclaimer, the term of this patent is extended or adjusted under 35 U.S.C. 154(b) by 1139 days.

(21) Appl. No.: 12/620,632

(22) Filed: Nov. 18, 2009

(65) Prior Publication Data

US 2010/0129760 A1 May 27, 2010

Related U.S. Application Data

(60) Provisional application No. 61/116,092, filed on Nov. 19, 2008.

(51) Int. Cl.
*F27D 3/06* (2006.01)

(52) U.S. Cl.
USPC ..... 432/239; 432/121; 432/137; 414/154

(58) Field of Classification Search
USPC ..... 432/88, 121, 136, 137, 143, 144, 239; 414/154; 264/652; 219/390, 405, 411; 148/112, 113, 580
See application file for complete search history.

(56) References Cited

U.S. PATENT DOCUMENTS

| | | | | | |
|---|---|---|---|---|---|
| 3,721,519 | A * | 3/1973 | Venetta | 432/88 |
| 4,118,016 | A * | 10/1978 | Westeren et al. | 266/130 |
| 4,160,680 | A * | 7/1979 | Novy et al. | 148/218 |
| 4,417,722 | A * | 11/1983 | Ishii et al. | 266/250 |
| 4,421,481 | A * | 12/1983 | Holz et al. | 432/239 |
| 5,524,020 | A * | 6/1996 | Jhawar et al. | 373/110 |
| 5,567,381 | A | 10/1996 | Carter | |
| 6,936,792 | B2 * | 8/2005 | Jones | 219/390 |
| 7,598,477 | B2 * | 10/2009 | Smith | 219/390 |
| 2002/0146659 | A1 * | 10/2002 | Muller-Ziller et al. | 432/121 |
| 2003/0217999 | A1 * | 11/2003 | Jones | 219/390 |
| 2004/0197168 | A1 * | 10/2004 | Meurs et al. | 414/150 |
| 2013/0171372 | A1 * | 7/2013 | Moore et al. | 427/542 |
| 2013/0172526 | A1 * | 7/2013 | Carvajal et al. | 530/202 |

* cited by examiner

*Primary Examiner* — Gregory A Wilson
(74) *Attorney, Agent, or Firm* — Dann Dorfman, Herrell and Skillman, P.C.

(57) ABSTRACT

A furnace loading system for use with a heat treating furnace is disclosed. The furnace loading system includes a platform and a support structure mounted on the platform. First and second transport rails are mounted on the support structure. The furnace loading system also includes a transfer cart that is adapted for supporting a work load and for moving along the transport rails. A lift mechanism is operatively mounted on the transfer cart for vertically displacing a work load supported on the transfer cart. The furnace loading system also includes a drive mechanism mounted on the support structure and operatively connected to the transfer cart for displacing the cart along the rails. A traction device is operatively connected to the platform for moving the furnace loading system relative to a heat treating furnace.

30 Claims, 7 Drawing Sheets

LOADING SYSTEM FOR A HEAT TREATING FURNACE

CROSS REFERENCE TO RELATED APPLICATION

This application claims the benefit of U.S. Provisional Application No. 61/116,092, filed Nov. 19, 2009, the entirety of which is incorporated herein by reference.

BACKGROUND OF THE INVENTION

1. Field of the Invention

This invention relates in general to industrial heat treating furnaces and in particular to a system for transporting a large work load into and out of a heat treating furnace.

2. Description of the Related Art

The load capacity of industrial heat treating furnaces has increased substantially over the last several years. The increase in the size of the work load that can be handled in a single furnace presents practical problems in loading and unloading the work load to be heat treated. For example, the use of fork lifts and other types of lift devices has proved inadequate for heavy, elongated work loads. The clearances inside the known vacuum heat treating furnaces are so close that damage to the heating elements, the work load supports, or other protruding components often results. Moreover, the stanchions that support the work load inside the furnace must be designed to resist transverse (bending) forces during horizontal translation of the work load inside the furnace.

One proposed solution to the problem of handling such large work loads is described in U.S. Pat. No. 6,936,792. That patent describes a load transfer cart which forms a part of the vacuum furnace itself. However, the apparatus described in that patent has inherent disadvantages. For example, the bottom heating elements of the heat treating furnace are integrated with the load transfer cart and thus, must be connected and disconnected with each load transfer. Also, the bottom section of the hot zone enclosure must be integrated with the transfer cart which adds to the complexity of the design. Further, the wheel bearings used on the transfer cart must be resistant to the high temperatures inside the heat treating furnace because the entire cart, including the wheels and bearings, remains inside the furnace during a heat treating cycle.

In view of the problems described above, it would be desirable to have a solution to the shortcomings of the known techniques and equipment for loading and unloading large, a heavy work load in a heat treating furnace.

SUMMARY OF THE INVENTION

The problems associated with the known furnace loading devices are solved to a large degree by a furnace loading system in accordance with the present invention. In general terms, a furnace loading system for use with a heat treating furnace according to the present invention includes a platform and a support structure mounted on the platform. First and second transport rails are mounted on the support structure to support a transfer cart. The transfer cart is adapted for supporting a load and for moving along the first and second transport rails. A lift mechanism is operatively mounted on the transfer cart for vertically displacing a work load supported on the transfer cart. A drive mechanism is mounted on the support structure and is operatively connected to the transfer cart for displacing the transfer cart along the transport rails. The furnace loading system of this invention also includes a traction arrangement that operatively connected to the platform for moving the furnace loading system relative to a heat treating furnace.

In accordance with another aspect of the present invention a heat treating system is provided that includes a furnace for heat treating large metal parts or assemblies and a loader for inserting a metal part or assembly into the heat treating furnace and for removing the metal part or assembly therefrom. The loader has first and second loader transport rails as described above. The heating treating furnace has first and second furnace transport rails. The loader includes a traction arrangement that is operative to moving the loader relative to the heat treating furnace such that the first and second loader transport rails are aligned with the first and second furnace transport rails.

DETAILED DESCRIPTION

Figure 1:
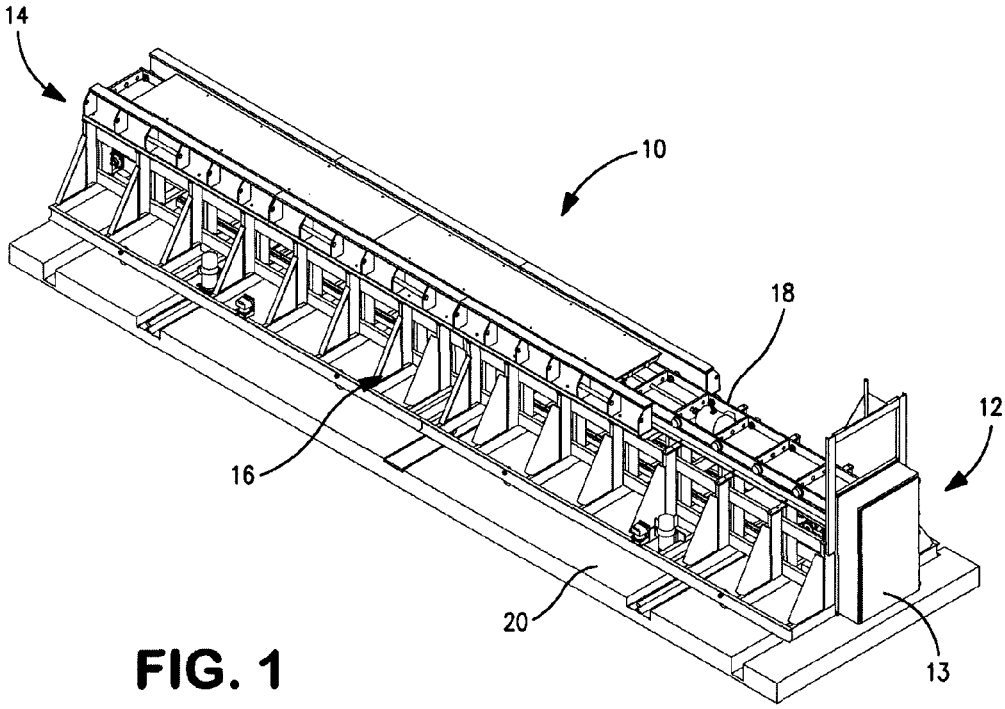
FIG. 1 is a first perspective view of an embodiment of a furnace loader in accordance with the present invention.
Figure 2:
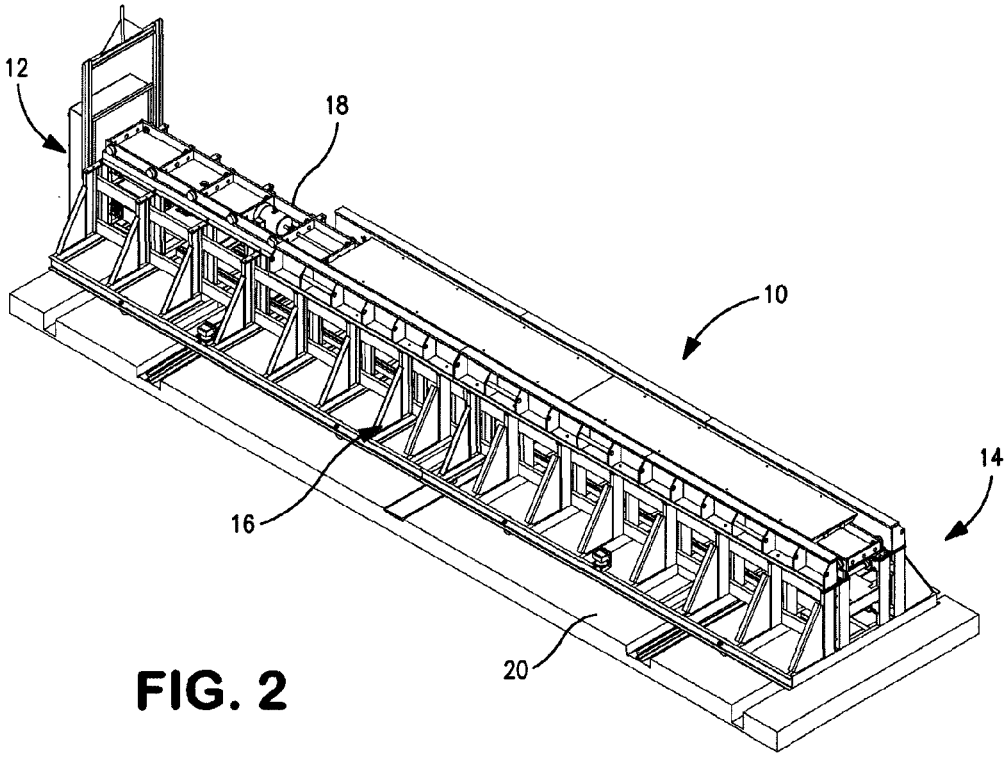
FIG. 2 is a second perspective view of the furnace loader shown in FIG. 1.

Referring now to the drawings wherein like reference numerals refer to the same or similar elements in the several views, and in particular to FIGS. 1 to 4, there is shown an embodiment of a furnace loader 10 in accordance with the present invention. The furnace loader 10 includes a back end portion 12 and a front end portion 14. A control panel 13 is disposed at the back end portion of the loader 10. The loader 10 also includes a support structure 16. A transfer cart 18 is movably disposed on rails that are supported by the support structure 16. The furnace loader 10 is adapted for sitting and moving on a floor or substrate 20.

Figure 3:
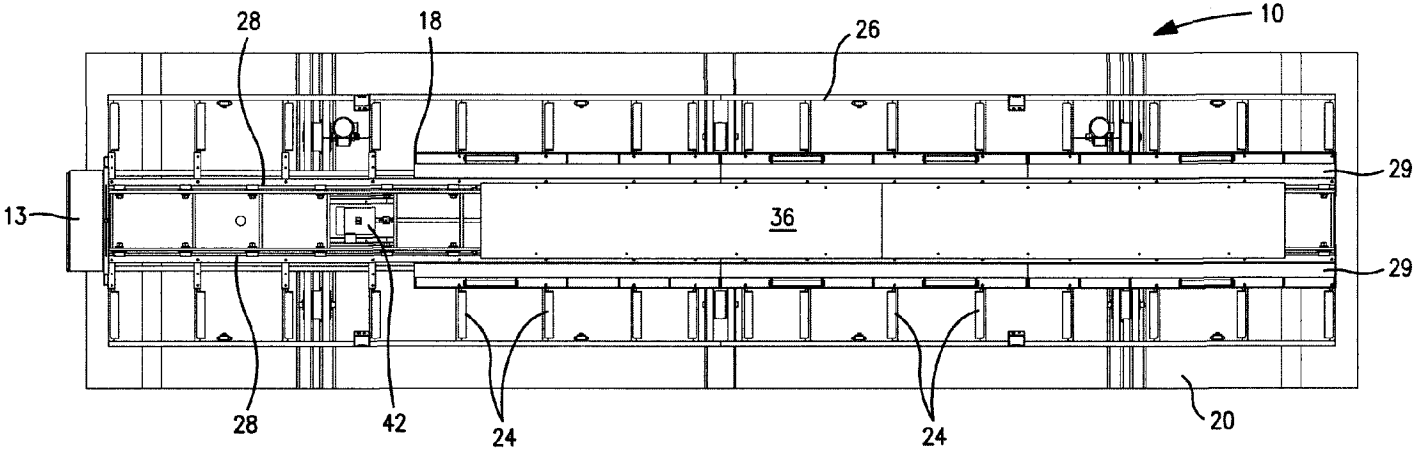
FIG. 3 is a top plan view of the furnace loader of FIG. 1.
Figure 6:
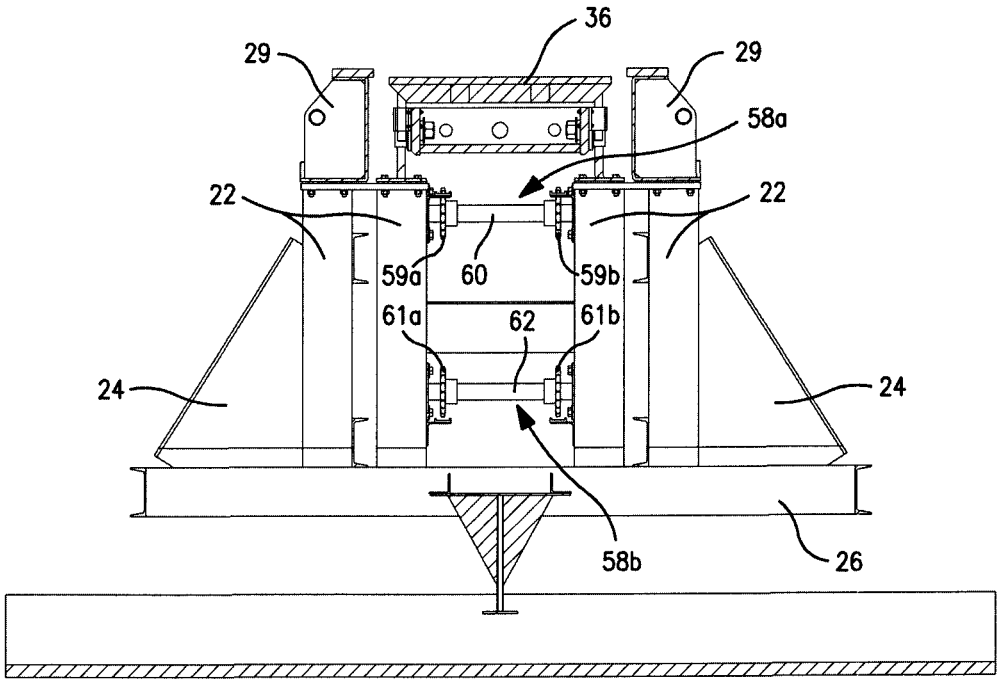
FIG. 6 is an elevation view of the furnace loader as viewed along line 6-6 in FIG. 4.
Figure 7:
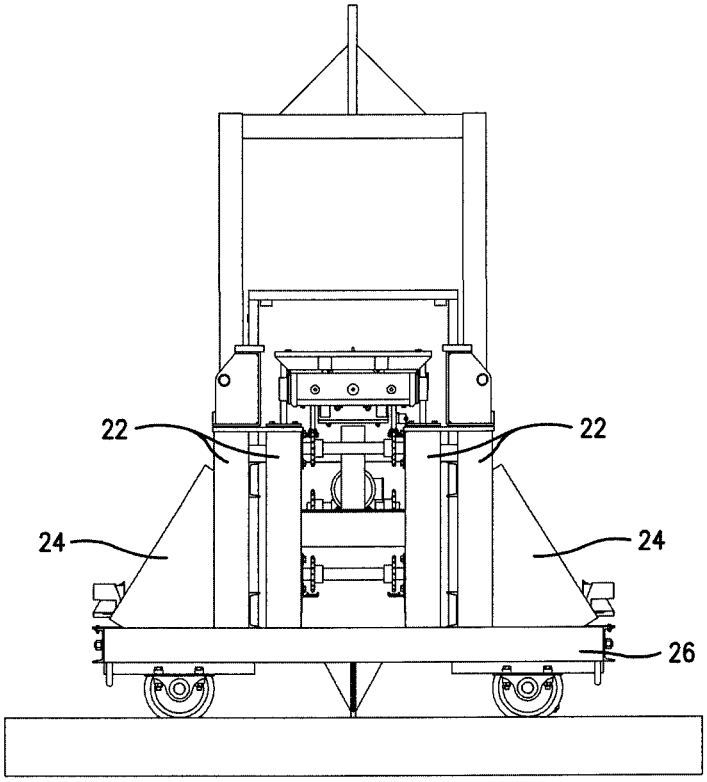
FIG. 7 is an elevation view of the front end of the furnace loader of FIG. 1.

As shown in FIGS. 3 and 6, the support structure 16 includes an elongated frame or platform 26 that is generally rectangular in plan view. The support structure 16 also includes a plurality of struts or columns 22 that extend vertically from the frame 26. The columns 22 are arrayed in pairs on opposite sides of a line that longitudinally bisects the loader 10. Each pair of struts includes an inner strut and an outer strut. The embodiment shown in the drawings further includes a plurality of gussets or buttresses 24. Each of the gussets 24 is attached, preferably by welding, between an outer support strut 22 and the frame 26 to provide lateral stability when the loader is carrying a large heavy load of work pieces to be heat treated. It will be appreciated, however, that the additional supports would not be necessary for a loader that will transport a smaller size load when in service. It is also noted that fewer support columns 22 could be used in the loader when the load size is relatively smaller.

A pair of rails 28 is attached to the tops of the support struts 22 and extends horizontally substantially the entire length of the loader. The transfer cart 18 is adapted for riding on the rails 28. As shown in FIG. 3, the transfer cart 18 has a long flat table 36 that is connected thereto for carrying a work load. A pair of load support rails 29 are positioned on opposite sides of the transfer cart 18 and affixed to the support struts 22. The load support rails 29 are dimensioned and positioned relative to the transfer cart 18 to stably support the work load when the loader 10 is moved laterally to position it relative to a heat treating furnace.

Figure 9:
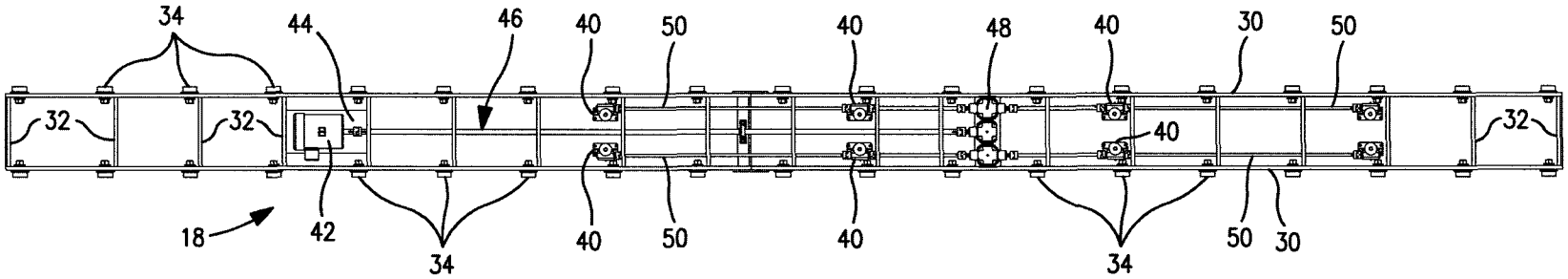
FIG. 9 is a top plan view of a load transfer cart used in the furnace loader of FIG. 1.
Figure 10:
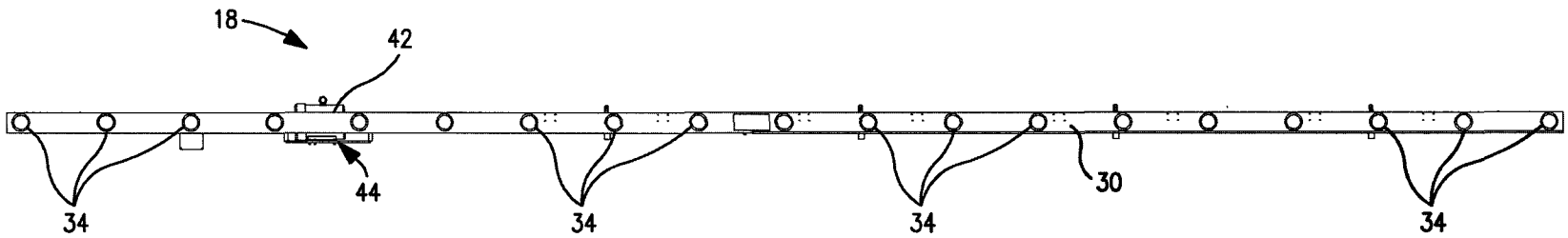
FIG. 10 is a side elevation view of the load transfer cart of FIG. 9.

The transfer cart main body is shown in greater detail in FIGS. 9 and 10. Two elongated beams 30 extend in parallel relationship to each other. A plurality of spreaders 32 are attached between the beams 30 at regular distances from each other to maintain the desired spacing between the beams 30 from one end of the transfer cart to the other. The beams 30 and spreaders 32 are formed of a strong, rigid material, preferably steel. A plurality of rollers 34 are attached to each of the rails 28 and positioned at regularly spaced intervals along the outward side of the beams 30.

The transfer cart 18 includes a lift mechanism for vertically displacing the table 36 such that a work load can be lifted or lowered when on the loader. As shown in FIG. 9, the lift mechanism preferably includes eight mechanical screw jacks 40. More or fewer jacks can be used depending on the size and weight of the work load to be handled by a given loader. Other types of lifting devices can be used in place of the screw jacks. For example, in another embodiment, cam lifting devices, lever-type lifting devices, scissor-type lifting devices, pneumatic bag lift devices, pneumatic cylinder lifts, or hydraulic type lift devices, can be used in place of the screw jacks. An electric motor 42 is mounted on a platform 44 in a space defined by the beams 30 and two of the spreaders 32. A drive shaft 46 connects the motor 42 to a gear box 48. The gear box 48 transmits rotation of the drive shaft 46 to auxiliary drive shafts 50. The auxiliary drive shafts 50 are operatively connected at their respective other ends to the screw jacks 40. Each screw jack 40 includes transmission means whereby rotation of the respective auxiliary drive shaft connected thereto is converted into vertical displacement of the lift portion of the jack.

Figure 5:
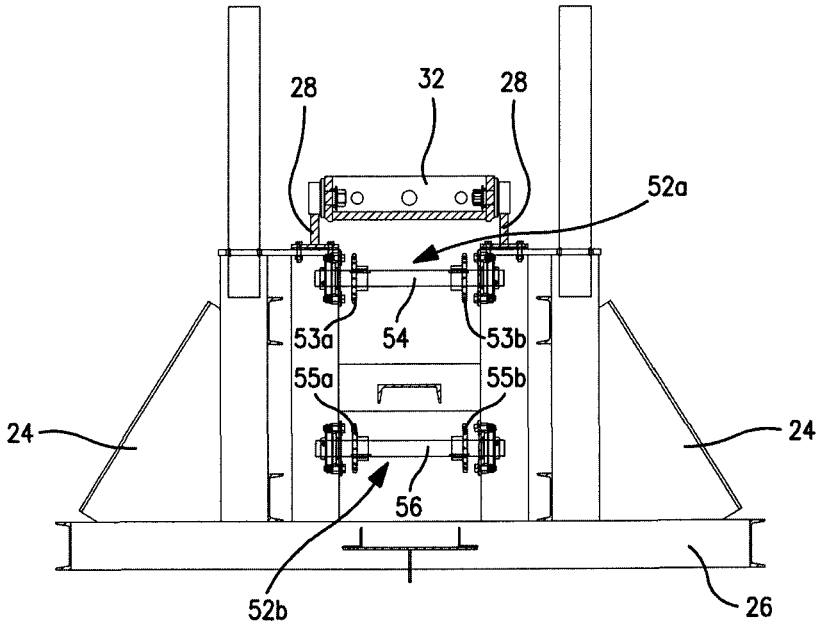
FIG. 5 is an elevation view of the furnace loader as viewed along line 5-5 in FIG. 4.
Figure 8:
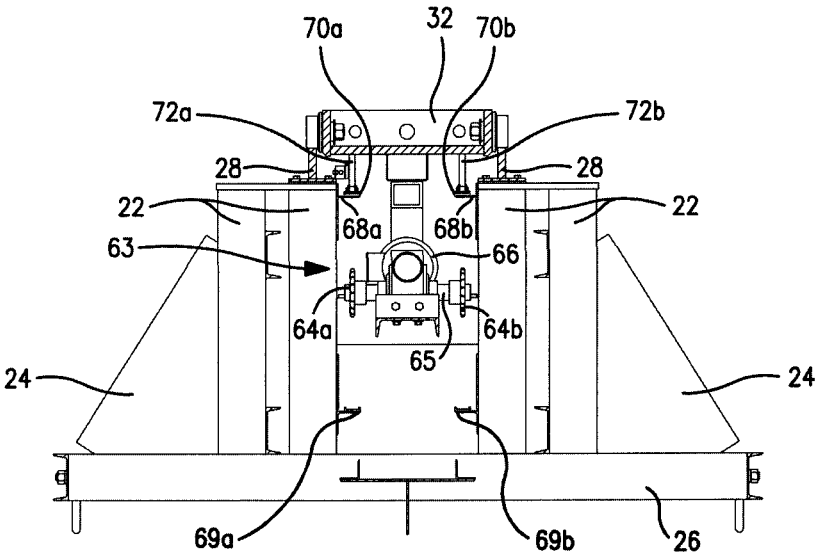
FIG. 8 is an elevation view of the furnace loader as viewed along line 8-8 in FIG. 4.

Referring now to FIGS. 5, 6, and 8, the furnace loader 10 has a drive mechanism for horizontally moving the transfer cart 18 into or out of a heat treating furnace. The drive mechanism includes an upper rear sprocket gear assembly 52*a* and a lower rear sprocket gear assembly 52*b*, both of which are shown in FIG. 5. The sprocket gear assemblies 52*a* and 52*b* are mounted in the support structure 16 proximal to the back end portion 12 of the loader 10. The transfer cart drive mechanism also includes an upper front sprocket gear assembly 58*a* and a lower front sprocket gear assembly 58*b*, as shown in FIG. 6. The sprocket gear assemblies 58*a* and 58*b* are mounted in the support structure 16 proximal to the front end portion 14 of the loader 10. The transfer cart drive mechanism further includes a drive sprocket assembly 63 as shown in FIG. 8. The drive sprocket assembly 63 is mounted in the support structure at a location that is between the front and rear sprocket assemblies, preferably closer to the rear sprocket assemblies.

The drive sprocket assembly 63 includes a first drive sprocket gear 64*a* and a second drive sprocket gear 64*b*. The first and second drive sprocket gears 64*a* and 64*b* are mounted on the ends of a drive shaft 65 that is operatively connected to a drive motor 66, preferably through a transmission gear box (not shown). The drive sprocket assembly 63 is suspended centrally between support stanchions 22 of the support structure 16 so that it is directly beneath the transfer cart 18.

Referring again to FIG. 5, upper rear sprocket gear assembly 52*a* includes a first sprocket gear 53*a* and a second sprocket gear 53*b*. The sprocket gears 53*a* and 53*b* are attached to the ends of a shaft 54 for rotation thereon or therewith. The lower rear sprocket gear assembly 52*b* includes a first sprocket gear 55*a* and a second sprocket gear 55*b*. The sprocket gears 55*a* and 55*b* are attached to the ends of a shaft 56 for rotation thereon or therewith.

Referring again to FIG. 6, upper front sprocket gear assembly 58*a* includes a first sprocket gear 59*a* and a second sprocket gear 59*b*. The sprocket gears 59*a* and 59*b* are attached to the ends of a shaft 60 for rotation thereon or therewith. The lower rear sprocket gear assembly 58*b* includes a first sprocket gear 61*a* and a second sprocket gear 61*b*. The sprocket gears 61*a* and 61*b* are attached to the ends of a shaft 62 for rotation thereon or therewith.

Referring back to FIG. 8, a first roller chain 70*a* is connected to the underside of transfer cart 18 with a bracket connector 72*a*. Roller chain 70*a* is operatively connected to the sprocket gears 53*a*, 55*a*, 59*a*, 61*a*, and 64*a*. Upper chain guides 68*a* and lower chain guides 69*a* are positioned along the support structure 20 to support roller chain 70*a* between the sprocket gears. A second roller chain 70*b* is connected to the underside of transfer cart 18 with a bracket connector 72*b*. Roller chain 70*b* is operatively connected to the sprocket gears 53*b*, 55*b*, 59*b*, 61*b*, and 64*b*. Upper chain guides 68*b* and lower chain guides 69*b* are positioned along the support structure 20 to support roller chain 70*b* between the sprocket gears.

Although the preferred embodiment described includes a chain drive mechanism for the transfer cart, it will be readily appreciated that other types of drive mechanisms can be used. For example, a rack and pinion gear drive arrangement could be used as could a hydraulic or pneumatic cylinder drive. Also, a ratchet drive system could be adapted for use as the transfer cart drive mechanism.

Figure 4:
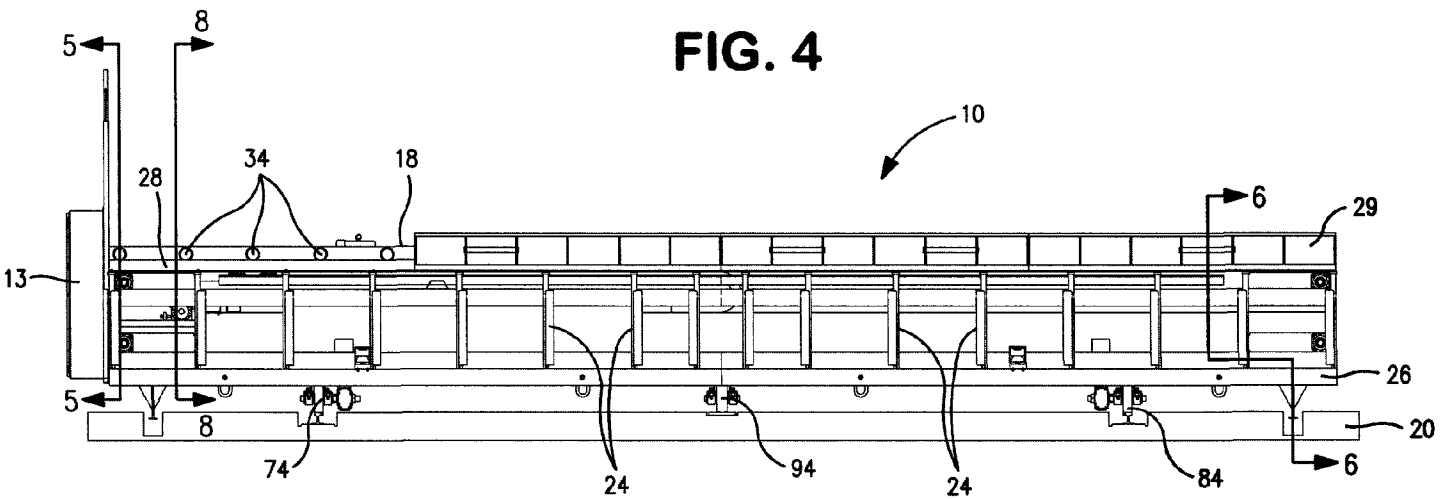
FIG. 4 is side elevation view of the furnace loader of FIG. 1.
Figure 12:
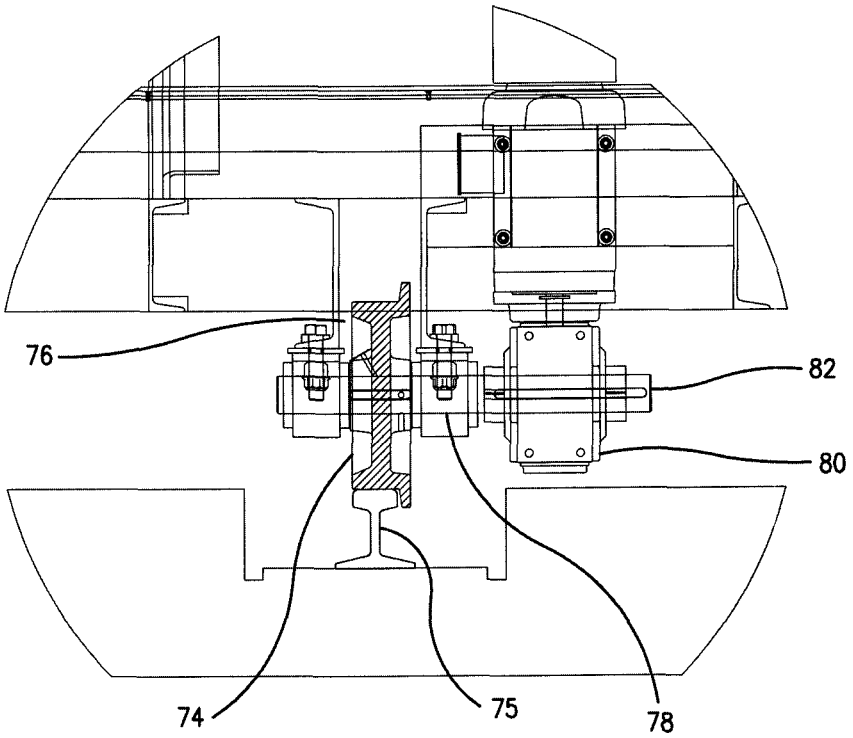
FIG. 12 is a detail view of a traction mechanism used in the furnace loader of FIG. 1.
Figure 13:
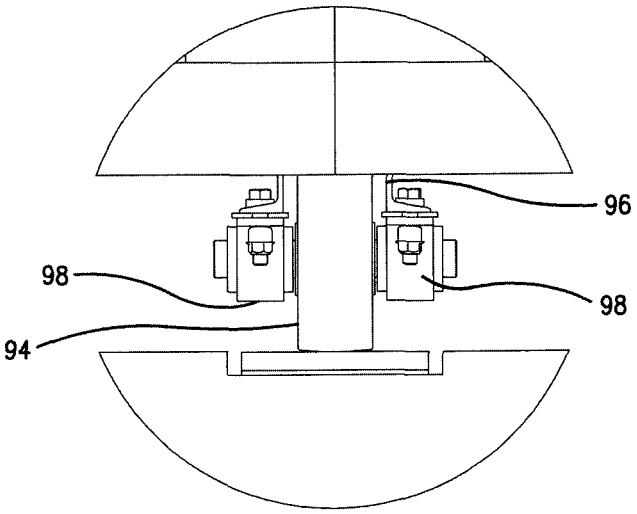
FIG. 13 is a detail view of a support wheel used in the furnace loader of FIG. 1.

The furnace loader according to the present invention includes a traction means for moving the loader relative to a heat treating furnace so that a work load can be moved between loading and unloading stations. Referring to FIGS. 4, 12, and 13 the loader 10 includes a first flanged wheel 74 and a second flanged wheel 84. The first flanged wheel 74 is attached to the underside of the lower frame 26 at a location proximal to the back end 12 of the loader 10. The second flanged wheel 84 is attached to the underside of the lower frame 26 at a location proximal to the front end 14 of the loader. A center wheel 94 is attached to the underside of the lower frame at a location that is between the first flanged wheel 74 and the second flanged wheel 84, preferably at or near the mid-point of the loader 10. The center wheel 94 is preferably used when the distance between the first flanged wheel 74 and the second flanged wheel 84 is so long that the frame 26 would bow or sag under the weight of the work load. Thus, for a relatively shorter embodiment of the loader according to this invention, a center wheel may not be required.

The construction of the traction wheels used in the loader 10 of the present invention will now be described with reference to FIG. 12 which exemplifies both. The first flanged wheel 74 is adapted to ride on a steel rail 75 disposed on the floor 20. Preferably, the rail 75 is set in a recessed channel formed in the floor 20. A traction motor 80 which is suspended from the lower frame 26 has a drive shaft 82. The flanged wheel 74 is connected to the drive shaft 82. A bracket 76 is provided to support a pair of bearing assemblies 78 on the lower frame 26 on opposing sides of the flanged wheel 74. The drive shaft 82 is supported in the bearing assemblies 78.

Referring now to FIG. 13, the center wheel 94 is mounted on a rotating shaft that is supported on a pair of wheel bearing assemblies 98. The bearing assemblies 98 are mounted with a pair of brackets 96 to the underside of the lower frame 26 on opposing sides of the center wheel 94.

Figure 11:
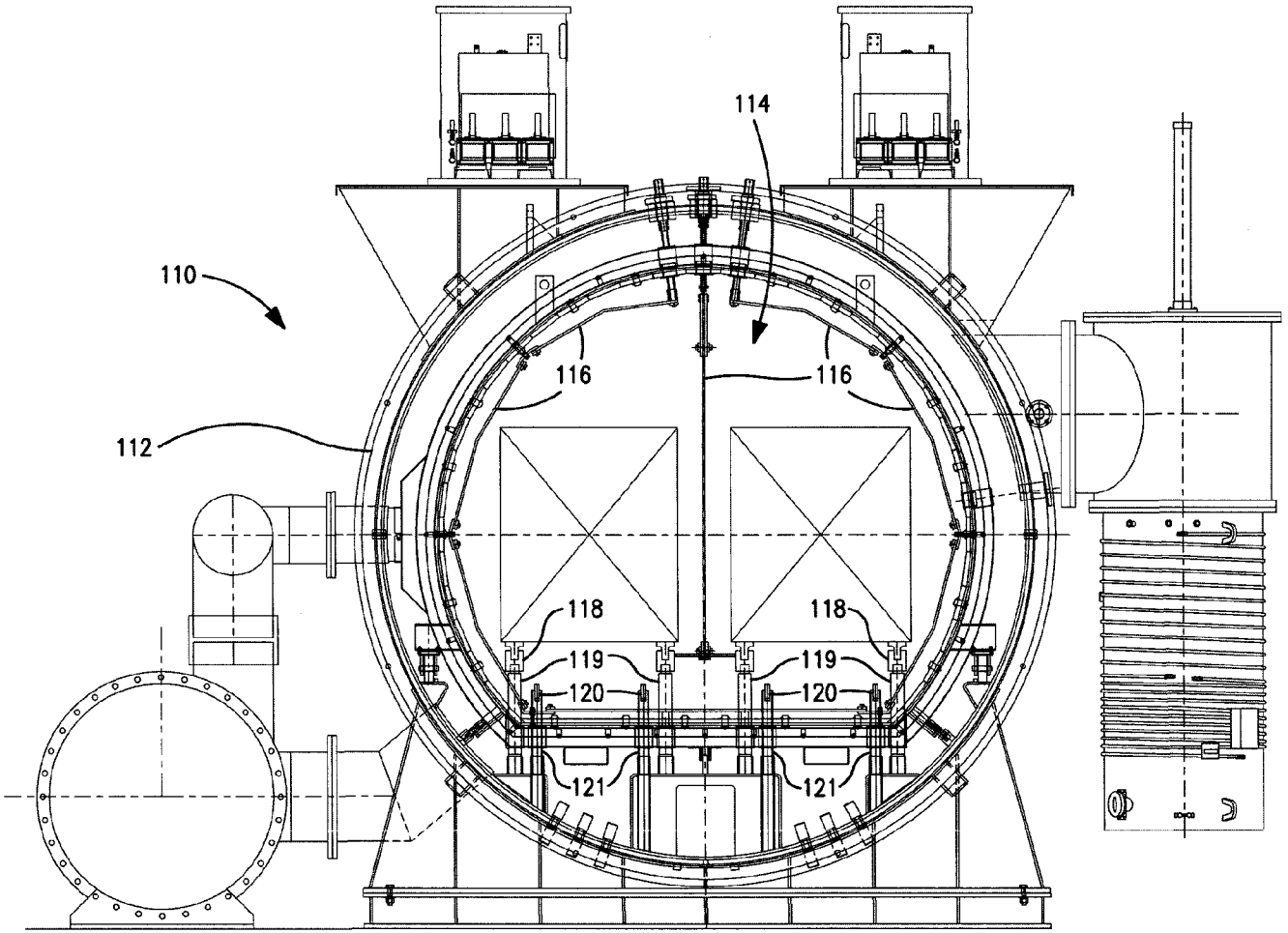
FIG. 11 is an end elevation view of a vacuum heat treating furnace for use with the furnace loader of FIG. 1.

The loader according to the present invention is used in connection with a heat treating furnace, preferably a vacuum heat treating furnace. Shown in FIG. 11 is a vacuum heat treating furnace 110 that is adapted for use with a loader according to the present invention. The furnace 110 includes a pressure vessel 112 which encloses a hot zone 114. The hot zone includes a plurality of heating elements 116 that are supported from the hot zone enclosure 115 in any known manner. Pairs of load support rails 118 are positioned inside the furnace 110 for supporting one or more work loads in the hot zone. The support rails 118 are supported from the floor of the pressure vessel 112 by vertical stanchions 119. Pairs of load transport rails 120 are also positioned in the furnace 110 and supported from the floor of the pressure vessel with support stanchions 121. As shown in FIG. 11, the load transport rails 120 are positioned between and below the load support rails 118. The load transport rails are preferably made of a heat resistant material that has sufficient strength to support the weight of the transfer cart and the work load. Although there are many materials that meet those criteria, examples of preferred materials include steel alloys, molybdenum, graphite, and ceramics.

The loader 10 according to the present invention is used in the following manner. The loader is initially positioned in a work load receiving station that is away from the heat treating furnace 110. Typically, the work load receiving station will be adjacent to and laterally displaced from the area in front of the heat treating furnace so that the work load can be accessed by a load transporter such as a fork lift truck or gantry crane. The work load is placed on the loader 10 and supported by the load support rails 29. When the load is securely seated on the load support rails and the load transporter is clear, the loader 10 is moved laterally into position in front of an open end of the heat treating furnace. The loader is positioned relative to the furnace hot zone 114 such that the transfer cart rails 28 on the loader 10 are aligned with the transfer cart support rails 120 in the heat treating furnace 110.

The load table 36 is then raised vertically by means of the screw jacks 40. As the load table rises, it lifts the work load off of the load support rails 29. When the load is clear of the load support rails, the transfer cart 18 is displaced into the heat treating furnace by means of the chain drive system. As the transfer cart 18 progresses into the furnace hot zone, the rollers 34 engage with the transfer cart support rails 120 to support the transfer cart and the work load inside the furnace. The transfer cart 18 is displaced until the work load is situated entirely within the hot zone 114. When the work load reaches the desired position in the hot zone, the load table 36 is lowered by means of the screw jacks 40 until the work load comes to rest on the load support rails 118. When the load table 36 is clear of the work load, the transfer cart 18 is withdrawn from the furnace by reversing its direction and retracting the transfer cart 18 to its initial position on the loader 10. The loader may be moved laterally away from the furnace either to obtain another work load or to permit the furnace to be closed so that the heat treating of the work load inside the furnace can proceed. It will be appreciated that when the heat treating cycle is completed, the work load is withdrawn from the furnace by reversing the above-described procedure for inserting the work load.

In view of the foregoing description, some of the advantages provided by the furnace loader according to the present invention will now be apparent. For example, the bottom heating elements can stay in the furnace, which means that there is no need to disconnect and re-connect any of the heating elements. The furnace loader of this invention obviates the need for a spare bottom hot zone section which would typically be used for setting up a load in advance of the one coming out of the furnace when using the known bottom loader cart. With the furnace loader of the present invention no hot zone parts need to be removed from the furnace. Accordingly, the hot zone parts stay better conditioned for vacuum service because they are less likely to absorb moisture or collect dirt. Further, the supporting posts for the hearth transfer the weight directly to the furnace vessel wall providing a stronger and more stable support for the work load. Further still the integrity of the hearth load bearing rails is maintained because the work load makes only vertical contact with the support rails and there is little likelihood of the support rails be bumped, scraped, or otherwise damaged when the work load is inserted or withdrawn from the furnace. Still another advantage of the loader according to this invention is that it does not need to be fabricated from heat resistant materials because no part of the loader remains inside the furnace during a heating cycle. As a still further advantage, it is noted that the furnace loader of this invention does not require the use of any bridging structure (rails, supports, etc.) between the cart and the furnace when a substantial distance must be maintained between the cart and the furnace.

The terms and expressions which have been employed are used as terms of description and not of limitation. There is no intention in the use of such terms and expressions of excluding any equivalents of the features shown and described or portions thereof. It is recognized, therefore, that various modifications are possible within the scope and spirit of the invention. Accordingly, the invention incorporates variations that fall within the scope of the following claims.

The invention claimed is:

1. A furnace loading system for use with a heat treating furnace comprising:

a platform;

a support structure mounted on said platform;

first and second transport rails mounted on said support structure;

a transfer cart adapted for supporting a load and for moving along said first and second transport rails;

a lift mechanism operatively mounted on said transfer cart for vertically displacing a work load supported on said transfer cart;

a drive mechanism mounted on said support structure and operatively connected to said transfer cart for displacing said transfer cart along said rails; and a traction device operatively connected to said platform for moving the furnace loading system relative to a heat treating furnace.

2. A furnace loading system as claimed in claim 1 wherein said support structure comprises a plurality of struts extending vertically from said platform at spaced intervals along the length of said platform.

3. A furnace loading system as claimed in claim 2 wherein each strut of said plurality of struts comprises a gusset or buttress attached between the strut and the frame.

4. A furnace loading system as claimed in claim 1 wherein said support structure comprises a first plurality of struts extending vertically from said platform at spaced intervals along the length of said platform and a second plurality of struts also extending vertically from said platform at spaced intervals along said length, said second plurality of struts being disposed outboard of said first plurality of struts.

5. A furnace loading system as claimed in claim 4 wherein each strut of said second plurality of struts comprises a gusset or buttress attached between the strut and the frame.

6. A furnace loading system as claimed in claim 1 wherein the support structure comprises first and second support rails positioned on opposite sides of said transfer cart for supporting the workload prior to vertical displacement of said lift mechanism.

7. A furnace loading system as claimed in claim 1 wherein said lift mechanism comprises a table for supporting the work load during vertical displacement of said lift mechanism.

8. A furnace loading system as claimed in claim 7 wherein said lift mechanism comprises a lifting device supported on the transfer cart and disposed for engaging with said table to provide vertical displacement thereof.

9. A furnace loading system as claimed in claim 8 wherein said lifting device is selected from the group consisting of screw jacks, cam lifters, lever-type lifters, scissor-type lifting devices, pneumatic lifting devices, hydraulic lifting devices, and a combination thereof.

10. A furnace loading system as claimed in claim 1 wherein said transfer cart comprises wheels or rollers disposed for engaging with said first and second transport rails such that said transfer cart can be rolled along said first and second transport rails.

11. A furnace loading system as claimed in claim 1 wherein said drive mechanism comprises:

a chain drive mechanism connected to said transfer cart; and a motor operatively coupled to said chain drive mechanism.

12. A furnace loading system as claimed in claim 1 wherein said drive mechanism comprises:

a rack and pinion gear drive arrangement; and a motor operatively coupled to said rack and pinion gear drive.

13. A furnace loading system as claimed in claim 1 wherein said traction device comprises:

a flanged wheel adapted for engaging with a rail, said flanged wheel being suspended from said platform; and a motor operatively connected to said flanged wheel for driving said flanged wheel to roll along the rail.

14. A furnace loading system as claimed in claim 13 wherein said traction device comprises:

a second flanged wheel adapted for engaging with a second rail, said second flanged wheel being suspended from said platform at a location spaced from said first flanged wheel; and a second motor operatively connected to said second flanged wheel for driving said second flanged wheel to roll along the second rail.

15. A furnace loading system as claimed in claim 14 wherein said traction device comprises a center wheel adapted for engaging with a floor surface under said furnace loading system, said center wheel being suspended from said platform and disposed intermediate said first flanged wheel and said second flanged wheel.

16. A system for heat treating large metal parts or assemblies comprising:

a heat treating furnace comprising:

a pressure vessel;

a hot zone enclosure disposed inside said pressure vessel;

a plurality of heating elements supported from the hot zone enclosure;

first and second load support rails mounted in the pressure vessel for supporting a metal part or assembly;

first and second furnace transport rails mounted in the pressure vessel adjacent to said pair of load support rails; and a furnace loading system for use with the heat treating furnace comprising:

a platform;

a support structure mounted on said platform;

first and second loader transport rails mounted on said support structure;

a transfer cart adapted for supporting a load and for moving along said first and second loader transport rails;

a lift mechanism operatively mounted on said transfer cart for vertically displacing a work load supported on said transfer cart;

a drive mechanism mounted on said support structure and operatively connected to said transfer cart for displacing said transfer cart along said loader transport rails; and a traction device operatively connected to said platform for moving the furnace loading system relative to the heat treating furnace such that the first and second loader transport rails align with the first and second furnace transport rails.

17. A system as claimed in claim 16 wherein said support structure comprises a plurality of struts extending vertically from said platform at spaced intervals along the length of said platform.

18. A system as claimed in claim 17 wherein each strut of said plurality of struts comprises a gusset or buttress attached between the strut and the frame.

19. A system as claimed in claim 16 wherein said support structure comprises a first plurality of struts extending vertically from said platform at spaced intervals along the length of said platform and a second plurality of struts also extending vertically from said platform at spaced intervals along said length, said second plurality of struts being disposed outboard of said first plurality of struts.

20. A system as claimed in claim 19 wherein each strut of said second plurality of struts comprises a gusset or buttress attached between the strut and the frame.

21. A system as claimed in claim 16 wherein the support structure comprises first and second support rails positioned on opposite sides of said transfer cart for supporting the workload prior to vertical displacement of said lift mechanism.

22. A system as claimed in claim 16 wherein said lift mechanism comprises a table for supporting the work load during vertical displacement of said lift mechanism.

23. A system as claimed in claim 22 wherein said lift mechanism comprises a lifting device supported on the transfer cart and disposed for engaging with said table to provide vertical displacement thereof.

24. A system as claimed in claim 23 wherein said lifting device is selected from the group consisting of screw jacks, cam lifters, lever-type lifters, scissor-type lifting devices, pneumatic lifting devices, hydraulic lifting devices, and a combination thereof.

25. A system as claimed in claim 16 wherein said transfer cart comprises wheels or rollers disposed for engaging with said first and second transport rails such that said transfer cart can be rolled along said first and second transport rails.

26. A system as claimed in claim 16 wherein said drive mechanism comprises:

a chain drive mechanism connected to said transfer cart; and a motor operatively coupled to said chain drive mechanism.

27. A system as claimed in claim 26 wherein said drive mechanism comprises:

a rack and pinion gear drive arrangement; and a motor operatively coupled to said rack and pinion gear drive.

28. A system as claimed in claim 16 wherein said traction device comprises:

a flanged wheel adapted for engaging with a rail, said flanged wheel being suspended from said platform; and a motor operatively connected to said flanged wheel for driving said flanged wheel to roll along the rail.

29. A system as claimed in claim 28 wherein said traction device comprises:

a second flanged wheel adapted for engaging with a second rail, said second flanged wheel being suspended from said platform at a location spaced from said first flanged wheel; and a second motor operatively connected to said second flanged wheel for driving said second flanged wheel to roll along the second rail.

30. A system as claimed in claim 29 wherein said traction device comprises a center wheel adapted for engaging with a floor surface under said furnace loading system, said center wheel being suspended from said platform and disposed intermediate said first flanged wheel and said second flanged wheel.

* * * * *